United States Patent [19]

Pinto

[11] Patent Number: 4,676,067

[45] Date of Patent: Jun. 30, 1987

[54] MAXIMIZED THERMAL EFFICIENCY CRANK DRIVEN HOT GAS ENGINE

[76] Inventor: Adolf P. Pinto, 3209 Dalemead St., Torrance, Calif. 90505

[21] Appl. No.: 594,030

[22] Filed: Mar. 27, 1984

[51] Int. Cl.[4] ..... F02G 1/04

[52] U.S. Cl. ..... 60/525; 60/682; 60/650

[58] Field of Search ..... 60/525, 682, 650

[56] References Cited

U.S. PATENT DOCUMENTS

| | | | |
|---|---|---|---|
| 3,867,816 | 2/1975 | Barrett | 60/682 |
| 4,077,221 | 3/1978 | Maeda | 60/682 X |
| 4,487,020 | 12/1984 | Dineen | 60/525 X |

*Primary Examiner*—Allen M. Ostrager

[57] ABSTRACT

An improved crank driven reciprocating piston hot gas engine in which virtually the entire working gas mass performs the same Ericsson cycle loop, thereby achieving maximized thermal efficiency. The invention engine embodiments consist of paired hot and cold cylinders, connected together through leak sealed flow paths with included valves and regenerator. Embodiments are presented for both the open cycle and closed cycle operations. The improvements consist of relative piston crank positioning and timed valve operation such that the working gas that started the isothermal expansion in a hot cylinder essentially remains in that hot cylinder for the entire duration of the isothermal expansion step, and the working gas that started the isothermal compression in a cold cylinder essentially remains in that cold cylinder for the entire duration of the isothermal compression step. The second improvement concerns the heat transfer within the cylinders. In the invention embodiments heat transfer area is generated inside the cylinders, within the volumes swept by the pistons, thus minimizing the void or dead space inside the cylinders.

5 Claims, 10 Drawing Figures

MAXIMIZED THERMAL EFFICIENCY CRANK DRIVEN HOT GAS ENGINE

SUMMARY OF THE INVENTION

Figure 1:
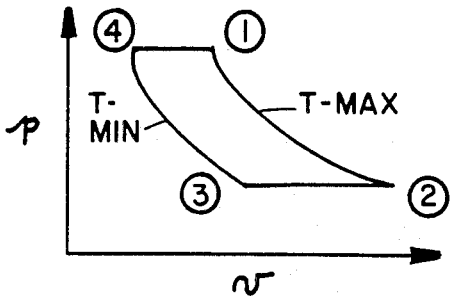
Figure 3:
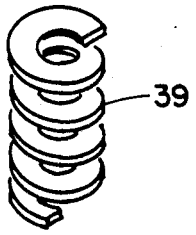
Figure 4:
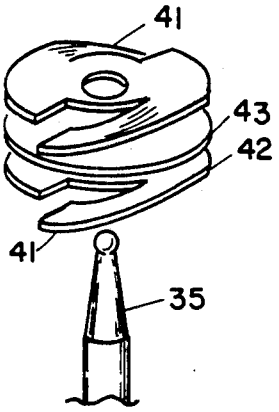
Figure 2:
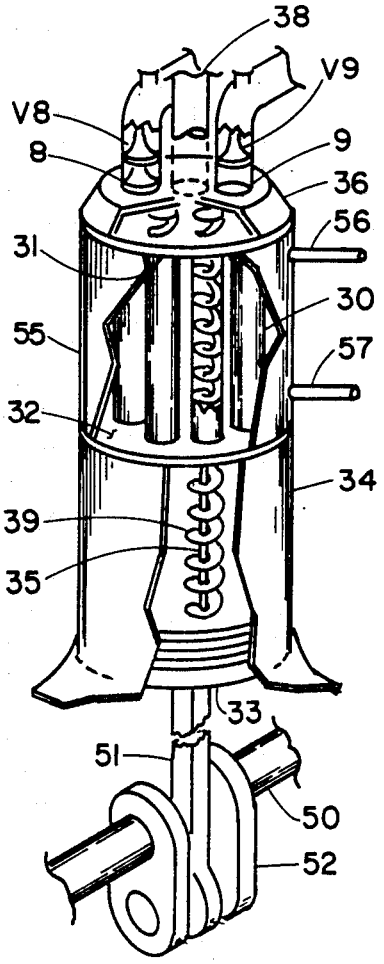
Figure 5:
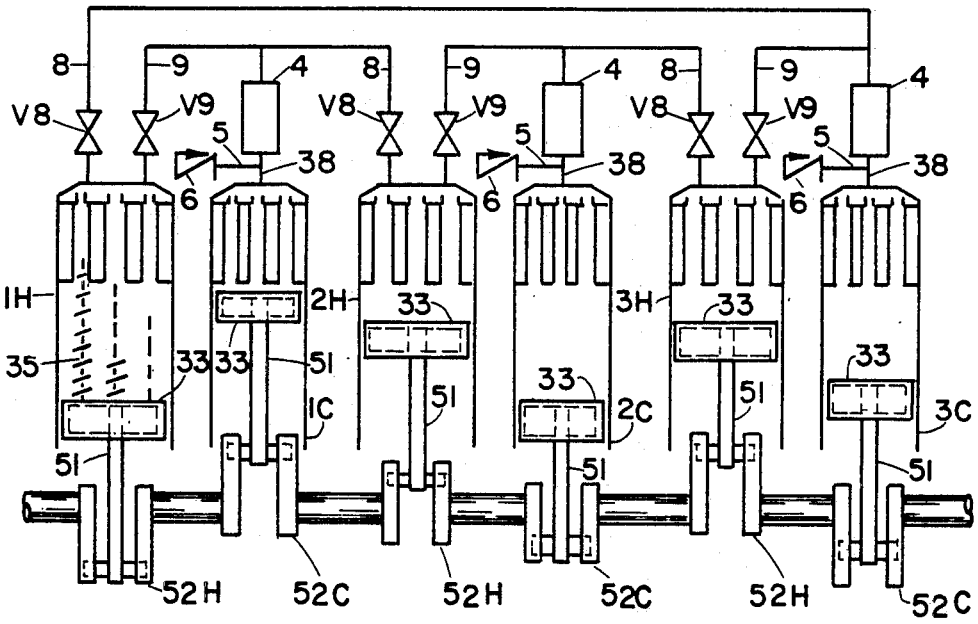
Figure 6A:
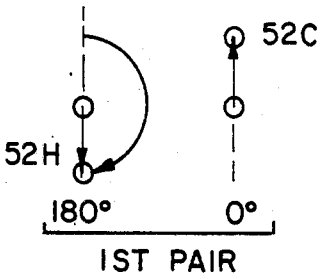
Figure 6B:
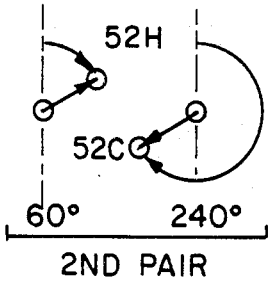
Figure 6C:
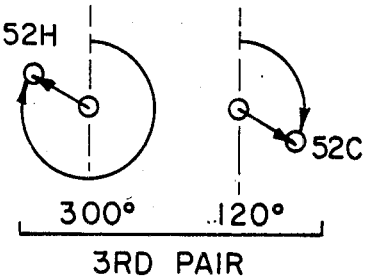
Figure 7:
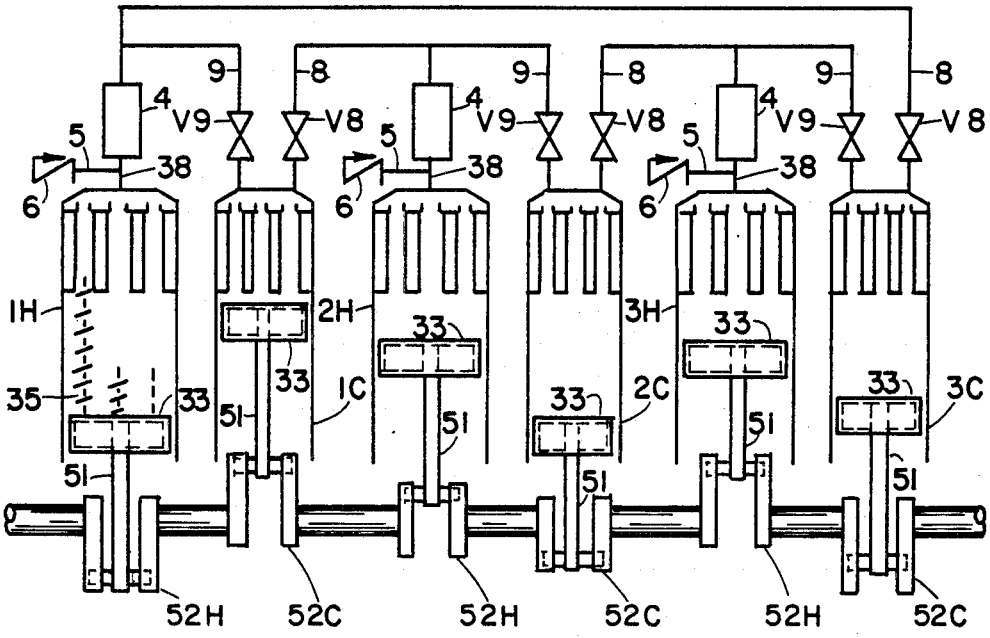
Figure 8:
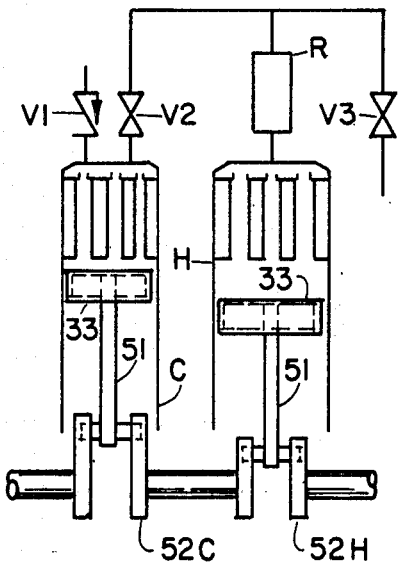

This invention relates to an improved reciprocating piston, crank driven hot gas engine in which the entire working gas mass performs the same Ericsson cycle loop, thereby achieving maximized thermal efficiency. The invention engine embodiment consists of pairs of cylinders, connected sequentially through valved ports and serially connected heat regenerator for controlled working gas operation. The improvement consists of the angular positioning of the cranks which drive the pistons in the cylinders, timed operation of the valves with respect to crank position, and means to generate additional heat transfer area inside the cylinders, within the volumes swept by the pistons. The improvements permit the working gas to be simultaneously heated and expanded in a hot cylinder, transferred to its cold cylinder pair, where it is simultaneously cooled and compressed, before being transferred to the next hot cylinder in sequence. The last cold cylinder is connected to the first hot cylinder. The relative angular crank positioning and timed valve improvements permit all the working gas that started the expansion in a hot cylinder to essentially all remain in the hot cylinder during the entire expansion step, and all the working gas that started the compression in a cold cylinder to essentially all remain in the cold cylinder for the entire compression step.

BACKGROUND OF THE INVENTION

In the majority of hot gas engine embodiments, the heating and cooling of the working gas takes place outside the cylinders. Thus, the working gas contained in the volume swept by the piston does not get properly heated during the expansion and properly cooled during compression. Hence, the actual cycle in these embodiments is different from either the Stirling or the Ericsson cycles and these hot gas engines cannot achieve Carnot efficiency. There are hot gas engines where the heating and cooling regions are incorporated within the cylinder volumes swept by the pistons. However, in these embodiments quantities of the working gas continuously cross over from the hot cylinder to the cold cylinder while the expansion is in progress, and from the cold cylinder to the hot cylinder while the compression is in progress. It can be shown that the working gas that is present in the cold cylinder during each instant that the expansion is in progress, and the working gas that is present in the hot cylinder during each instant that the compression is in progress contribute negative work cycles that reduce the thermal efficiency of the engine from the Carnot efficiency.

It is therefore desirable to provide a hot gas engine whose thermal efficiency is maximized by ensuring that virtually all the working gas that was in the hot cylinder at the start of the expansion step remains in the hot cylinder for the duration of the expansio step, and all the working gas that was in the cold cylinder at the start of the compression step remains in the cold cylinder for the duration of the compression step. Also, isobaric working gas transfer from cylinder to cylinder is optimized by making the hot and cold cylinder volumes such that they are in the same ratio as the absolute temperatures of their isothermal processes.

Additionally, in the hot gas engines with heating and cooling surfaces provided within the cylinder volumes swept by the pistons, the heat transfer surface is generated by having piston projections which mesh with coresponding noncontacting depressions in the cylinder housing. In order to generate the quantities of heat transfer area that are generally required, the number of projections becomes inordinately large. This large number of projections results in void volume within the cylinders which adversely affects the thermal efficiency and engine performance.

In the proposed invention embodiment the number of projections is limited to control the void volume; however each projection is made up of laminations that are made to separate from each other when the piston descends from its top dead center position, to generate large additional heat transfer areas for transfer of heat into or from the expanding or compressing working gas respectively.

DESCRIPTION OF THE INVENTION EMBODIMENTS

The invention may be best understood from the following description of the invention embodiments in conjunction with the accompanying figures in which:

FIG. I is a diagram of the Ericsson cycle depicted on a pressure—volume plot. The invention cycle is identical to the Ericsson cycle, wherein the working gas process steps are: 1 to 2 is isothermal expansion in the hot cylinder at temperature $T_{max}$; 2 to 3 is isobaric transfer of the working gas from the hot cylinder to the cold cylinder with heat storage enroute in the regenerator; 3 to 4 is isothermal compression in the cold cylinder at temperature $T_{min}$; and 4 to 1 is isobaric transfer of the working gas from the cold cylinder to the hot cylinder with heat recovery enroute from the regenerator.

FIG. II is an isometric view showing pertinent features of a hot or cold cylinder.

FIG. III is a detail showing a spring like spiral used to increase the surface area for heat transfer into and from the working gas.

FIG. IV is a detail of an alternate arrangement for increasing the surface area for heat transfer. Shown are discs, with builtin springs, which come together when the piston is at top dead center and spring apart as the piston descends towards bottom dead center.

FIG. V is a schematic showing a hot gas engine system made up of three pairs of hot and cold cylinders.

FIGS. VI*a*, VI*b* and VI*c* show instantaneous relative piston crank positions of the hot gas engine system of FIG. V.

FIG. VII is a schematic of the hot gas engine with the regenerator and valves included in the leak sealed flow paths connecting the cylinders, equivalently but differently, from that in FIG. V.

FIG. VIII is a schematic of the hot gas engine where the working gas is used in an open cycle as opposed to a closed cycle.

FIG. II of the drawings is an isometric view of a hot or cold cylinder. The hot and cold cylinders are not identical, since the hot cylinder is larger than the cold cylinder. Also the hot cylinder is provided with means to add heat through its heat transfer surfaces, and the cold cylinder is provided with means to remove heat. However the construction features relating to the improvements of this invention are the same in the hot and cold cylinders, and hence only one figure is used to describe them.

Each hot or cold cylinder (FIG. II) consists of a cylindrical shell(34) inside which operates piston(33) which is connected to crank(52) through connecting rod(51). Crank(52) turns crank shaft(50). There is a special angular crank positioning of each piston(33) with respect to the other pistons as described under FIG. V. Attached to cylindrical shell(34) at the opposite end from where connecting rod(51) connects to crank(52), hereafter referred to as its upper end, is a shell and tube heat exchanger. The shell and tube heat exchanger consists of a tube sheet, hereafter referred to as lower plate(32), tubes(30), another tube sheet, hereafter referred to as upper plate(31), and heat exchanger shell(55). Lower plate(32) is fluid sealed at it's circumferential edges to the upper end of cylindrical shell(34). Tubes(30) are parallel to each other, and are fluid sealed at their upper and lower ends to appropriate openings in upper plate(31) and lower plate(32). Heat exchanger shell(55) is fluid sealed at one end to the circumferential edge of lower plate(32) and at the other end to the circumferential edge of upper plate(31), and is provided with upper nozzle(56) and lower nozzle(57) for the introduction and removal of the heating fluid in the case of the hot cylinder, and the cooling fluid in the case of the cold cylinder. On the upper surface of piston(33) are provided a multiplicity of rod like projections(35). The length of the rod like projections is such that with the piston at top dead center, where the clearance between the upper surface of piston(33) and the lower surface of plate(32) is as small as possible for high speed operation, the top of projection(35) comes close to but does not touch the lower surface of flat lid(36), which is fluid sealed to the upper surface of upper plate(31) at its outer circumferential edges. In the case of the hot cylinders the lids(36) are provided with two fluid sealed ports(8) and (9) with valves (V8) and (V9) respectively. The cold cylinders are each provided with only one fluid sealed port(38). The ports of each hot and cold cylinder are connected as described later and shown in FIG. V. Means such as a cam shaft are provided to operate each of valves (V8) and (V9) in conjunction with the rotational positions of their respective piston cranks. Valve timing details are described later.

The length of tubes(30) is such that with piston(33) at bottom dead center the upper ends of rod like projections(35) come close to but do not descend below the lower ends of tubes(30). Positioned around projections(35) is coiled spring(39) with a large number of coils. FIG. III is an exploded view showing a portion of coiled spring(39). Coiled spring(39) differs from an ordinary spring in that it is not made up of wire. The cross section of the member it is made up of is not circular but rectangular. The inner and outer radii of coiled spring(39) are such that the spring is free to expand and compress, but the gaps between the inner edges of coiled spring(39) and projection(35) and the outer edges of spring(39) and inner surfaces of tubes(30) are minimized. The number of coils, thickness and total length of coiled spring(39) are such that with the spring fully compressed when piston(33) is at its top dead center position, the length of the spring is the same as that of tubes(30), thus in effect eliminating the void spaces in the hot and cold cylinders; and when piston(33) is at its bottom dead center position, spring(39) is still restrained at its upper end by flat lid(36) and at its lower end by the upper surface of piston(33). As an alternate to spring(39) a large number of thin annular discs with inner and outer radii similar to that of coiled spring(39) may be provided. The number and thickness of the discs are such that with piston(33) at top dead center the discs are close together and effectively fill the void spaces in tubes(30). When piston(33) descends from top dead center, means are provided to cause the discs to space themselves apart. In FIG. IV arc like segments(41) are pressed from discs(42) to form a lock washer type spring. Adjacent discs(42) are separated from each other by a plain disc(43).

The volume bounded by the upper surface of piston(33), inside walls of shell(34), lower surface of plate(32), inside walls of tubes(30), upper surface of plate(31), and lower surface of lid(39) not occupied by projections(35) and springs(39) forms the working volume of the cylinder occupied by the working gas. When piston(33) is at its top dead center position this volume is minimum and by design this volume is made as close to zero as possible. When piston(33) is at its bottom dead center position this volume is maximum and by design the maximum working volumes in the hot and cold cylinders are made to be in the same ratio as the absolute temperatures of their isothermal expansion and compression processes respectively.

FIG. V shows the elements of a three pair hot gas engine system schematically. The schematic presentation is to simplify the drawing and discussion. Since the cylinders are connected sequentially in a closed loop, there is no first and last pair of cylinders. However, for purposes of discussion the cylinder pairs will be numbered one to three from left to right. Thus 1H and 1C, 2H and 2C, and 3H and 3C are the hot and cold cylinders of the first, second, and third pairs respectively. Each hot cylinder is connected to its paired cold cylinder through a leak sealed flow path(9) containing valve(V9), serially connected heat regenerator(4) and flow path(38). Flow path(38) is provided with make-up working gas flow path(5) with one-way check valve(6). A source of make-up working gas, appropriately pressure regulated if necessary, is connected to the inlets of one-way check valves(6). Each cold cylinder is connected to the next hot cylinder in sequence through a portion of the previously described flow path from the paired hot cylinder; which includes flow path(38) and regenerator (4), and an additional section of flow path(8) with included valve(V8).

Each hot cylinder piston crank(52H) is positioned 180 degrees away from its next cold cylinder piston crank(52C) and an angle theta ahead of the preceding cold cylinder piston crank(52C). It can be shown for an n pair cylinder system, where n is an integer greater than 1, that angle theta=180/n degrees when n is odd, and theta=360/n degrees when n is even. For the three pair cylinder system under discussion theta=180/3=60 degrees. It can be shown that the compression ratio of the hot gas engine system, defined by the working gas volume at 2 divided by the working gas volume at 1 (FIG. I); also the same as the working gas volume at 3 divided by the working gas volume at 4 is related to the angle theta by the expression:

$$\text{Compression Ratio} = 2/[\{1-\text{Cos}(\text{theta})\}+\{(R/2L)\text{Sin}^2(\text{theta})\}[$$

where R is the crank radius, and L is the length of the connecting rod.

FIGS. VI*a*, VI*b* and VI*c* show the special angular piston crank positioning of the pistons relative to each other. FIG. VI*a* shows the instantaneous piston positions for the first, FIG. VI*b* and second and FIG. VI*c* the third pair of cylinders. The angular position indicated for each piston represents its position and direction of travel in its respective cylinder. 0 degrees indicates the top dead center (TDC) position and 180 degrees the bottom dead center (BDC) position. At the instant of time depicted in FIGS. VI*a*, VI*b* and VI*c* the piston in hot cylinder 1H is at its BDC position (its crank is at 180 degrees). Since each hot cylinder crank is positioned 180 degrees away from its paired cold cylinder crank, the piston in cold cylinder 1C is at its TDC or 0 degrees. Also since each hot cylinder crank is an angle theta (which in this case is 60 degrees) ahead of its preceding cold cylinder crank, the piston in cold cylinder 3C will be at 120 degrees. Following the same reasoning the pistons in hot cylinder 2H, cold cylinder 2C, and hot cylinder 3H will be at 60, 240, and 300 degrees respectively at the instant of time under consideration.

The special valve timing with respect to crank position will be described next. Valves(V9) are provided with means to open them when their respective hot cylinder pistons reach their BDC positions, and keep them open till their respective pistons reach TDC at which time they are closed and kept in the closed position till their respective pistons once again are at BDC. Valves(V8) are provided with means to open them when their respective hot cylinder pistons are at TDC and keep them open till the respective preceding cold cylinder piston reaches TDC, at which time they are closed and remain closed till their respective hot cylinder piston is again at TDC. Thus, for the three pair system under discussion each valve(V9) is open when its respective hot cylinder crank position is between 180 and 360 degrees, and closed between 0 and 180 degrees; and each valve(V8) is open when its respective hot cylinder crank is between 0 and 60 degrees and closed between 60 and 360 degrees. This valve timing permits the working gas masses to flow from cylinder to cylinder sequentially and at the proper time when their isothermal expansion or compression processes are completed.

OPERATION

The operation will be described using FIGS. V, VI*a*, VI*b* and VIc; and with reference to the process steps shown in FIG. I. There are four separate working gas masses undergoing the Ericsson cycle in the three pair cylinder system under discussion. These will be referred to as the first, second, third, and fourth working gas masses and are defined in the discussion that follows. At the instant of time depicted on FIGS. V, VI*a*, VI*b* and VI*c* the fourth working gas mass is entirely present in hot cylinder 1H and is at process state 2, the third working gas mass is entirely present in hot cylinder 2H and is at process state 1, the second working gas mass is approximately a third of the way into the isothermal compression process step 3→4 and is entirely present in cold cylinder 2C, and the first working gas mass is approximately two thirds of the way into process step 2→3 with approximately one third of the first working gas mass in hot cylinder 3H and the remaining two thirds in cold cylinder 3C. It can be shown that the number of working gas masses depends on the number of cylinder pairs; with seven working gas masses in a five pair cylinder system, and nine working gas masses in a seven pair cylinder system.

The processes taking place in hot cylinder 1H during one complete rotation of crank shaft(50) from the instant of time depicted on FIGS. V, Vi*a*, VI*b* and VI*c* will be described next. At the instant of time depicted on FIGS. V, Vi*a*, VI*b* and VI*c* the piston in hot cylinder 1H is at BDC. From the discussion on valve timing, valve(V8) on 1H is closed but valve(V9) on 1H has just opened. Also at this instant of time valve(V8) on 2H has just closed. Hence, when the piston in hot cylinder 1H rises from BDC, it displaces the fourth working gas mass from hot cylinder 1H through valve(V9) and the regenerator above cold cylinder 1C, into cold cylinder 1C, whose piston is descending from TDC. The fourth working gas mass leaves hot cylinder 1H at process state 2 but after passing through the regenerator enters cold cylinder 2C at process state 3. Thus process step 2→3 for the fourth working gas mass takes place during this one half rotation, ending with the piston in hot cylinder 1H at TDC and the piston in cold cylinder 1C at BDC. At the instant of time the piston in hot cylinder 1H reaches TDC, valve(V9) on hot cylinder 1H closes and valve(V8) on 1H opens and stays open for the next 60 degrees of rotation of the crank shaft. Thus, for the next 60 degrees of rotation, while the piston in hot cylinder 1H descends from TDC, it receives the first working gas mass from cold cylinder 3C. The first working gas mass leaves cold cylinder 3C at process state 4 and after passing through the regenerator above 3C enters hot cylinder 1H at process state 1. It may be noted that during this period of time the piston in cold cylinder 3C travels from 300 degrees to TDC and valve(V9) on 3H is closed. As the rotation continues, the piston in hot cylinder 1H descends from 60 degrees to BDC and the first working gas mass performs the isothermal expansion process step 1→2. This completes the description for hot cylinder 1H for one complete rotation of the crank shaft from the instant of time depicted in FIGS. V, VI*a*, VI*b* and VI*c*. For the next and successive rotations of the crank shaft the same processes take place in hot cylinder 1H except that the other working gas masses get processed in sequence, with the first working gas mass following the fourth working gas mass. The description of operation of the other hot cylinders 2H and 3H closely parallels that of hot cylinder 1H and will not be repeated.

The processes taking place in cold cylinder 1C during one complete rotation of crank shaft(50) from the instant of time depicted on FIGS. V, VI*a*, VI*b* and VI*c* will be described next. At the instant of time depicted on FIGS. V, VI*a*, VI*b* and VI*c* the piston in cold cylinder 1C is at TDC or 0 degrees. For the next one half rotation as its piston descends from TDC, cold cylinder 1C receives the first working gas mass from hot cylinder 1H, as described in the previous paragraph. Thus, when its piston is at BDC, cold cylinder 1C contains the entire fourth working gas mass at process state 3. Also at this instant of time valve(V9) on hot cylinder 1H closes, valve(V8) on 2H is already closed and remains closed. Hence, as the rotation of crank shaft(50) continues, the fourth working gas mass undergoes process step 3→4 in cold cylinder 1C as its piston rises from its BDC position. The process step 3→4 for the fourth working gas mass is complete in cold cylinder 1C when its piston reaches 300 degrees. At this instant of time, when the piston in cold cylinder 1C has reached 300 degrees, the piston in hot cylinder 2H has just reached TDC, valve(V8) in 2H has just opened (valve(V9) on 1H is closed) permitting the fourth working gas mass in cold cylinder 1C at process state 4 to flow through the regenerator into hot cylinder 2H at process state 1. The fourth working gas mass thus executes process step 4→1 which is just completed when the piston in cold cylinder 1C has just reached TDC. This completes the description for cold cylinder 1C for one complete rotation of the crank shaft(50) starting from the instant of time depicted in FIGS. V, VI*a*, VI*b* and VI*c*. For the next and successive rotations of the crank shaft(50), the same processes take place in cold cylinder 1C, except that the other working gas masses get processed in sequence, with each successive rotation; with the first working gas mass following the fourth working gas mass. The description of operation of the other cold cylinders 2C and 3C closely parallels that of cold cylinder 1C and will not be repeated.

The pressure at process states 2 and 3 will be the working gas supply pressure to the inlets of check valves(6). The pressure at process states 4 and 1 will be the compression ratio times the pressure at process states 2 and 3. When the engine is initially started by cranking crank shaft(50), after the heating and cooling sources are applied to the hot and cold cylinders respectively, there will be a brief period of unsteady state operation while the pressures stabilize. There is also a period of unsteady state operation during which the required temperature gradients are set up in the regenerators.

In the schematic presentation of FIG. V it appears that the gas flow paths between the cylinders are very long. In the actual set up, by design, the cylinders and regenerators are positioned so as to make the gas flow path lengths as short as possible to minimize void volume. The gas flow path cross-sections in the flow paths and regenerators are so chosen that there is a trade off between the desired low gas flow pressure drop and low void volume of the working gas outside the hot and cold cylinders.

The function of projections(35) on the upper surface of pistons(33) is solely to hold the springs(39) in place as the piston(33) descends from its TDC position. Projections of other shapes and designs may be used. One specific design may be a telescoping rod with one end attached to the upper surface of piston(33) and the other end attached to the lower surface of lid(36). Also the pistons(33) are shown with a circular cross-section. A piston with any cross-sectional shape including an annular cross-section can be used. Also the cross-sections of tubes(30) are shown circular. Any other cross-section is also possible. All that is required is that what appears as a solid projection on the top of the piston surface, fitting into a matching cavity in the cylinder head when the piston is at TDC; separates into numerous laminations as the piston descends from TDC, thus creating additional surface area for transfer of heat to or from the working gas. It is this heat transfer that permits the working gas expansion in a hot cylinder, and compression in a cold cylinder to be isothermal. When the piston is at TDC the individual coils of spring(39) are capable of relatively rapid heat transfer with the inside surfaces of tubes(30). Heat transfer aiding means such as low volatility heat transfer lubricants may be used to facilitate the heat transfer between the inside surfaces of tubes(30) and the coils of spring(39).

In FIG. VII the regenerator and valves are included differently but equivalently to that in FIG. V. Each cold cylinder is provided two flow ports (8) and (9), with included valves V8 and V9 respectively and each hot cylinder is provided with only one flow port(38). Also the regenerator is a common element in the flow path from a hot cylinder to its next cold cylinder and the flow path from that cold cylinder to its next hot cylinder. The description of the operation with the FIG. VII configuration is similar to that just presented for FIG. V and will not be repeated.

OPEN CYCLE ENGINE

A special case of the hot gas engine operating on an open cycle is shown in FIG. VIII. In this method of operation the working gas would be lost t the atmosphere after each cycle. Hence, economics would dictate that this method could normally be used only if atmospheric air was used as the working gas. The apparatus required for this method consists of one pair of hot and cold cylinders. Accordingly, in FIG. VIII are presented a cold cylinder C and a hot cylinder H together with fluid sealed flow paths with included one-way check valve V1, crank position controlled valves V2 and V3, and regenerator R. The piston crank in cold cylinder C leads the piston crank in hot cylinder H by an angle theta (where theta is less than 180 degrees). The magnitude of the angle theta determines the compression ratio. The difference between the closed cycle and open cycle embodiments is that in the open cycle embodiment the angle theta can be selected to obtain any desired compression ratio. Valve timing is such that valve V2 is open when cold cylinder C piston is between theta degrees before TDC and TDC, and closed at other times; valve V3 is open when hot cylinder H piston is between 180 degrees and 360 degrees and closed at other times.

WORKING OF THE OPEN CYCLE ENGINE

From the discussion on valve timing, valve V2 would have just closed as the piston in cold cylinder C reached its TDC position. For the next half rotation of the crank shaft as the piston in cold cylinder C descended from TDC to its BDC position, cold cylinder C would draw in a fresh charge of working gas from the atmosphere through one way check valve V1. When the piston in cold cylinder C reaches BDC one-way check valve V1 does not permit the working gas inside cooling cylinder C to leave, valve V2 is already closed, and for the next part of the crank shaft rotation till the piston in cold cylinder C reaches angle theta before TDC the charge of working gas is compressed in cold cylinder C undergoing the isothermal compression step 3→4 of FIG. I. When the piston in cold cylinder C reaches the angle theta before its TDC position, the piston in hot cylinder H would have reached its TDC position and valve V2 would have just opened. For the next theta degrees of rotation the compressed working gas from cold cylinder C would be transferred to hot cylinder H through valve V2 and regenerator R, picking up the heat that was deposited in regenerator R in the previous cycle, and entering hot cylinder H at process state 1 of FIG. I. As the rotation of the crank shaft continues, the working gas in hot cylinder H undergoes the isothermal expansion process 1→2 while the next charge of working gas is drawn into cold cylinder C through one-way check valve V1. When the piston in hot cylinder H reaches BDC the isothermal expansion process step 1→2 is complete and valve V3 opens. For the next half a rotation of the crank shaft as the hot cylinder H piston rotates from 180 to 360 degrees, the expanded working gas in hot cylinder H is exhausted to the atmosphere through regenerator R, where it deposits its heat. The cycle is called an open cycle because each fresh charge of working gas is drawn from the source of working gas supply, and after completing the Ericsson cycle, is discharged back to the source of working gas supply.

In the above descriptions of the closed and open cycle embodiments, a simple type of regenerator in which the flow paths to and from the hot cylinder share a common flow channel in the regenerator is shown. The invention is applicable to other types of regenerators as well. In the case of these other regenerators, if there is more than one valve present in the same flow path, the valve timing criteria for the serially included valve on that line will apply to the other valves as well.

What is claimed is:

1. A method for converting heat to mechanical shaft work in a reciprocating piston crank driven hot gas engine, said engine consisting of a pair of hot and cold cylinders connected together with leak sealed flow paths, said flow paths having included valves and regenerator, said method comprising:

(a) drawing the working gas, from a working gas supply source, into the cold cylinder;

(b) compressing the working gas in the cold cylinder with simultaneous removal of heat to keep the compression isothermal;

(c) trapping the working gas in the cold cylinder during the isothermal compression, so that no working gas may enter or leave the cold cylinder during the isothermal compression;

(d) setting the crank angular relationship between the hot and cold cylinder pistons such that the hot cylinder piston leads the cold cylinder piston by an angle whose magnitude determines the compression ratio of the engine;

(e) transferring the working gas after the isothermal compression, from the cold cylinder to the hot cylinder, with addition of heat from the regenerator;

(f) expanding the working gas in the hot cylinder with the simultaneous addition of heat to keep the expansion isothermal;

(g) trapping the working gas in the hot cylinder during the isothermal expansion, so that no working gas may enter or leave the hot cylinder during the isothermal expansion;

(h) expelling the expanded working gas from the hot cylinder to the working gas supply source with deposition of heat in the regenerator for addition to the compressed working gas of the next cycle in step (e);

(i) selecting the hot and cold cylinder volumes to be approximately in the same ratio as the absolute temperatures of their respective isothermal processes such that the working gas transfers between them are isobaric.

2. A method, for converting heat to mechanical shaft work in a reciprocating piston crank driven hot gas engine, the engine consisting of a plurality of pairs of hot and cold cylinders connected in sequence with a cold cylinder following a hot cylinder and a hot cylinder following a cold cylinder and the last cylinder connected to the first cylinder to form a closed loop, said cylinders connected with leak sealed flow paths, said flow paths having included valves and regenerator, said regenerator being a common element in successive pairs of adjacent flow paths, said cylinders processing sequentially a number of working gas masses, said number of working gas masses depending on the said number of pairs of cylinders, said method comprising:

(a) expanding said working gas masses in sequence in said hot cylinders with simultaneous addition of heat to keep the expansions isothermal;

(b) trapping said working gas masses inside said hot cylinders, such that no working gas may enter or leave each of said hot cylinders during each of the isothermal expansions;

(c) setting the piston crank relationships of each said hot cylinder and its succeeding cold cylinder, such that each said cold cylinder will be ready to receive the expanded working gas mass from the hot cylinder which it succeeds, when the isothermal expansion is completed in the hot cylinder which it succeeds;

(d) transferring said working gas masses after their said isothermal expansions are completed, from the hot cylinders in which the isothermal expansions were performed to the cold cylinders succeeding those hot cylinders, with deposition of heat in the regenerator included in the flow path connecting each said hot cylinder and its succeeding cold cylinder;

(e) compressing said working gas masses in said cold cylinders with simultaneous removal of heat to keep the compressions isothermal;

(f) trapping said working gas masses inside said cold cylinders such that no working gas may enter or leave each of said cold cylinders during each of said isothermal compressions;

(g) setting the piston crank relationships of each said cold cylinder and its succeeding hot cylinder such that each said hot cylinder will be ready to receive the compressed working gas mass from the cold cylinder which it succeeds, when the isothermal compression is completed in the cold cylinder which it succeeds;

(h) transferring said working gas masses after their said isothermal compressios are completed, from the cold cylinders in which said isothermal compressions were performed to the hot cylinders succeeding those cold cylinders, with addition of heat from the regenerator included in the flow path connecting each said cold cylinder and its succeeding hot cylinder;

(i) selecting the hot and cold cylinder volumes to be in approximately the same ratio as the absolute temperatures of their isothermal processes, such that the working gas transfers between them are isobaric.

3. A crank driven reciprocating piston hot gas engine comprising:

(a) a pair of cylinders;

(b) a piston connected to reciprocate in each of said cylinders by means of a connecting rod and crank;

(c) each said piston and cylinder defining a working chamber for the processing of a working gas;

(d) means to heat the working gas in one of the working chambers, the cylinder associated with this working chamber being called the hot cylinder;

(e) means to cool the working gas in the other working chamber, the cylinder associated with this working chamber being called the cold cylinder;

(f) the maximum volumes of the working chambers in the hot and cold cylinders selected to be in approximately the same ratio as the absolute temperatures of the working gas in the hot and cold cylinders;

(g) leak sealed flow paths with serially included valves and regenerator for drawing the working gas into the cold cylinder from a working gas supply source, transferring the working gas from the cold cylinder to the hot cylinder, and for expelling the working gas from the hot cylinder to the working gas supply source;

(h) said regenerator being a common element in the flow paths from the cold cylinder to the hot cylinder and from the hot cylinder to the working gas supply source;

(i) an angle by which the hot cylinder piston leads the cold cylinder piston, the magnitude of the angle determining the compression ratio of the engine;

(j) means for timing the valve such that the valve(s) in the flow path from the cold cylinder to the hot cylinder is (are) open from approximately the instant of time the hot cylinder piston reaches top-dead-center (TDC) to approximately the instant of time the cold cylinder piston reaches TDC and are closed at other times, and the valve(s) in the flow path from the hot cylinder to the working gas supply source is (are) open while the hot cylinder piston is travelling from approximately bottom-dead-center (BDC) to approximately TDC and are closed at other times, thereby causing the working gas that started the isothermal compression in the cold cylinder to essentially remain in the cold cylinder for the entire duration of the isothermal compression step, and the working gas that started the isothermal expansion in the hot cylinder to essentially remain in the hot cylinder for the entire duration of the isothermal expansion step.

4. A crank driven reciprocating piston hot gas engine having:

(a) an even number of cylinders greater than two;

(b) a piston connected to reciprocate in each of said cylinders by means of a connecting rod and crank;

(c) each said piston and cylinder defining a working chamber for the processing of a working gas;

(d) means to heat the working gas in half of the working chambers, the cylinders associated with these working chambers being called hot cylinders;

(e) means to cool the working gas in the remaining half of the working chambers, the cylinders associated with these working chambers being called cold cylinders;

(f) the maximum volumes of the working chambers in the hot and cold cylinders selected to be in approximately the same ratio as the absolute temperatures of the working gas in the hot and cold cylinders;

(g) leak sealed flow paths connecting the working chambers in sequence, with a cold cylinder following a hot cylinder and a hot cylinder following a cold cylinder, and the last working chamber connected to the first to form a closed loop;

(h) serially included valves and regenerator in the leak sealed flow paths, wherein successive pairs of adjacent flow paths share a common regenerator element;

(i) working gas masses processed sequentially and cyclically in said working chambers, the number of working gas masses depending on the number of pairs of cylinders;

(j) piston angular crank positioning such that each said hot cylinder piston is approximately 180 degrees out of phase with its succeeding cold cylinder piston, and leads its preceding cold cylinder piston by approximately an angle theta defined to be 180/n degrees when n is odd and 360/n degrees when n is even, where n is the number of pairs of said cylinders; and means for timing the valve such that the valve(s) in the flow path from a said hot cylinder to its succeeding cold cylinder is (are) open from approximately the instant of time the hot cylinder piston reaches bottom-dead-center (BDC) to approximately the instant of time the same hot cylinder piston reaches top-dead-center (TDC) and are closed at other times, and the valve(s) in the flow path from a said cold cylinder to its succeeding hot cylinder is (are) open from approximately the instant of time the cold cylinder piston reaches the angle theta (defined above) away from TDC to approximately the instant of time the same cold cylinder piston reaches TDC and are closed at other times; thereby causing the working gas that started the isothermal expansion in a said hot cylinder to essentially remain in that cylinder for the entire duration of the isothermal expansion step in that hot cylinder, and the working gas that started the isothermal compression in a said cold cylinder to essentially remain in that cold cylinder for the entire duration of the isothermal compression step in that cold cylinder.

5. An improved crank driven reciprocating piston hot gas engine as defined in claim 4, wherein the heating and cooling means comprise:

(a) a heat exchanger for each said cylinder, said heat exchanger positioned next to the main body of the cylinder, for adding heat to the working gas in the hot cylinder, and for removing heat from the working gas in the cold cylinder;

(b) projections on the surface of each said piston, said projections fitting into those portions of the heat exchanger accessible to the working gas, said projections being made up of numerous components designed to be close together when said piston is at top dead center, and to space themselves apart as said piston is positioned away from top dead center.

* * * * *